United States Patent [19]

Hague

[11] Patent Number: 4,594,823

[45] Date of Patent: Jun. 17, 1986

[54] PANEL SUPPORT ASSEMBLY FOR CONCEALED FASTENER ROOF STRUCTURE

[76] Inventor: James G. Hague, Box 159C, Davidson Rd., Mars, Pa. 16046

[21] Appl. No.: 670,517

[22] Filed: Nov. 13, 1984

Related U.S. Application Data

[63] Continuation of Ser. No. 427,655, Sep. 29, 1982, abandoned.

[51] Int. Cl.[4] ..... E04B 7/02; E04C 3/30

[52] U.S. Cl. ..... 52/90; 52/543; 52/573; 52/632; 52/726; 403/306

[58] Field of Search ..... 52/90, 543, 544, 545, 52/551, 632, 633, 726, 407, 520, 529, 713, 714, 394, 395, 536, 309.2–309.5, 410, 573; 403/300, 306, 309, 313

[56] References Cited

U.S. PATENT DOCUMENTS

| | | | |
|---|---|---|---|
| 2,102,902 | 12/1937 | Lenke | 52/395 |
| 2,841,255 | 7/1958 | Kemp | 52/395 |
| 3,054,482 | 9/1962 | Lassen | 52/726 |
| 3,077,960 | 2/1963 | Lang | 403/4 |
| 3,085,666 | 4/1963 | Lydard | 52/407 |
| 3,716,958 | 2/1973 | Scrivener | 52/713 |
| 4,114,338 | 9/1978 | Beck | 52/551 |
| 4,145,859 | 3/1979 | Ollinger | 52/726 |
| 4,219,981 | 9/1980 | Stewart et al. | 52/529 |
| 4,248,021 | 2/1981 | Dyer | 52/404 |
| 4,285,182 | 8/1981 | Dinges | 52/543 |
| 4,296,581 | 10/1981 | Heckelsberg | 52/544 |
| 4,333,291 | 6/1982 | Musgrave | 52/410 |
| 4,397,127 | 8/1983 | Mieyal | 52/632 |
| 4,400,922 | 8/1983 | Boyer | 52/543 |
| 4,466,224 | 8/1984 | Hague | 52/544 |
| 4,486,998 | 12/1984 | Hague | 52/544 |
| 4,528,789 | 7/1985 | Simpson | 52/410 |

FOREIGN PATENT DOCUMENTS

| | | | |
|---|---|---|---|
| 80682 | 3/1956 | Denmark | 52/633 |
| 1509063 | 3/1969 | Fed. Rep. of Germany | 52/90 |
| 1394950 | 12/1965 | France | 52/633 |
| 828920 | 2/1960 | United Kingdom | 52/633 |

*Primary Examiner*—John E. Murtagh
*Assistant Examiner*—Andrew Joseph Rudy

[57] ABSTRACT

A panel support assembly is disclosed for use in concealed fastener roof systems. An array of rows and columns of support assemblies can be erected in a manner which facilitates "moduling" of the panel members to conform the panel coverage to that required by the steel framing. In each row, means is provided for incrementally increasing or decreasing a selected modular distance between fixed clip means of adjacent support assemblies thereby to accommodate differences between the "as engineered" dimensions and the "as built" dimensions of the steel framing. An improved roof structure is disclosed utilizing rows of fixing, clipping, and sliding support assemblies arranged to allow problem-free thermal expansion and contraction of overlapping courses of the panel members.

21 Claims, 28 Drawing Figures

PANEL SUPPORT ASSEMBLY FOR CONCEALED FASTENER ROOF STRUCTURE

CROSS-REFERENCES TO RELATED APPLICATIONS

This is a continuation of Ser. No. 06/427655 filed Sept. 29, 1982 which in now abandoned.

BACKGROUND OF THE INVENTION

1. Field of the Invention

This invention relates to concealed fastening roof structures, and more particularly to improved panel support assemblies which provide consistent and accurate control of the panel module during erection, and which permit two or more courses of the panel members to move as a unit during thermal expansion and contraction.

2. Description of the Prior Art

Virtually all profiled panel members are fabricated by roll forming operations to established manufacturing tolerances to provide, for example, a 36" (91.44 cm) coverage width. However, the actual coverage width of the panel members may deviate from the intended 36" coverage width, by as much as ±3/16" (±0.476 cm). The deviations may be caused by clearances in the rolls of the roll forming equipment, which is necessary to accomodate various gauges of the sheet metal and decorative coating thickness and by coil-to-coil variations in the physical properties of the steel. These roll clearances and the physical property variations introduce varying degrees of permanent set and spring back in the material being roll formed thereby causing variations in the final shape of the ribs, and hence, in the coverage width.

Since the panel coverage cannot be precisely controlled at the time of manufacture, the roof installation must be engineered assuming a 36" coverage width. The panels must be installed so as to provide the 36" coverage width regardless of the actual manufactured panel width. This is normally accomplished in profiled panel members by "moduling" the panel member, that is by physically stretching or compressing the panel member to conform its width to the engineered width.

Concealed fastening roof systems are known which employ locator strips for precisely locating the concealed fasteners at a uniform spacing, see for example U.S. Pat. Nos. 3,716,958 (SCRIVNER) and 4,285,182 (DINGES). In erecting such systems, the erector can only maintain the intended panel module. The modular width of the panel cannot be adjusted to accommodate differences between the "as engineered" dimensions and the "as built" dimensions of the steel framing.

My copending application number 376,169 filed May 7, 1982, now U.S. Pat. No. 4,486,998, and assigned to assignee of this invention, discloses and claims a system by which "moduling" of the panel members may be consistently and accurately achieved. The system utilizes one fixed clip and two or more floating clips per panel member. The disclosed system relies on precisely locating the fixed clips to achieve the desired moduling of the panel members. The present invention constitutes an improvement over the aforesaid copending application Ser. No. 376,169, in that the present invention provides a means for varying the distance between the fixed clips during erection of the roof structure so as to accommodate the panel coverage to the coverage required by the erected steel framework.

In conjunction with the above-noted erection requirements, the concealed fastening system also must allow the panel members to undergo thermally induced movement, that is to move as a unit during thermal expansion and contraction. Certain profiled panel members of simplified design, may be roll formed at the job site to any required length. Such single length panel members may not be subject to buckling or seal rupture during thermal movement provided that the panel members are secured to the structural steel by suitable concealed fasteners.

Most concealed fastening roof systems utilize panel members whose length is limited by plant space, handling or shipping limitations. Such limited-length panels are erected in multiple courses which present lap joints wherein the panel ends of one course overlap those of the adjacent course. At the lap joint, the panel ends tend to move in opposite directions for a given thermal condition. Such movement may shear the sealant line, elongate fastener holes or shear fasteners all of which tend to degrade the lap joint seals and to produce undesirable leaks in the roof structure. Ideally, the multiple panel lengths should be joined in such a way that the multiple lengths respond to thermal inputs as would a single elongated sheet. This requires the lap joint condition to move as a unit and in a single direction rather than having the panel ends move in opposite directions. Many concealed fastening systems ignore thermally induced movement at the lap joints.

In other systems, the lap joint is spaced from the adjacent panel support assembly or the purlin so that the lap joint fasteners can move with the lap joint independently of the support. This approach results in an inherently weak end lap for one or more of the following reasons. The concealed fastener must physically contact the panel member in order to anchor it to the structural steel. Such contact results in frictional drag as thermal conditions cause the panels to expand and contract and slide past the concealed fastener. If the frictional resistance of the concealed fasteners on opposite side of the lap joint differ substantially, the panel ends undergo different rates of thermal expansion whereby the panel ends move in opposite directions. The end result is the same. That is, such movement may shear the sealant line, elongate fastener holes or shear fasteners thereby degrading the lap joint seal and causing undesirable roof leaks. As a further consideration, locating the end lap condition away from the support drastically increases the likelihood of damage to the lap joint fastening and to the sealant due to foot traffic and other live loads since no firm foundation exists beneath the lap joint to resist these forces. In addition, locating the lap joint condition away from a support creates a weak line of bending resistance since the overlapped sheets cannot be clamped effectively enough to produce the equivalent bending resistance of an unbroken sheet section.

SUMMARY OF THE INVENTION

The principal object of this invention is to provide an improved panel support assembly which facilitates "moduling" of the panel members and which allows problem-free thermal expansion and contraction of the assembled panel members.

Another object of this invention is to provide an improved panel support assembly having means for setting the depth of telescoping engagement between adjacent panel support assemblies whereby columns of the support assemblies may be erected with corresponding ends thereof in substantial alignment.

Still another object of this invention is to provide an improved support assembly to which overlapped ends of adjacent panel courses are fixedly secured and which will accommodate thermally induced movement of the panel members relative to the structural steel.

The present invention provides an improved panel support assembly including a subgirt having first and second ends adapted for telescoping engagement with the second and first ends of adjacent subgirts. Cooperating aperture sets are provided, one set at the first end and the other set at the second end, for setting the depth of engagement of the countersunk second end with the first end of the adjacent subgirt. Locking means are provided for locking the first and second ends of adjacent subgirts in adjusted relationship. The arrangement is such that an array of rows and columns of the support assemblies may be erected, wherein each of the rows comprises a plurality of the support assemblies erected in first end-to-second end telescoping engagement with the second ends of corresponding subgirts of each column substantially aligned along an imaginary line extending transversely of the rows.

As will be explained more fully later in the specification, each support assembly of certain rows, is provided with one fixed clip means and plural movable clip means for connecting the panel members to the support assembly. The incremental adjustments provided by the cooperating aperture sets allows the panel member coverage to be adjusted to accommodate differences between the "as engineered" dimension and the "as built" dimension of the steel framing. That is, any necessary adjustments can be predetermined by field measurement of the erected steel framing. Thus the erector has precise control over the erected panel module and permits the required module to be predetermined prior to the start of erection rather than reacting during construction to module problems as they occur.

The present invention also provides an improved support assembly comprising a stand-off support having an upper support flange, an elongated subgirt having spaced-apart outwardly directed subgirt flanges extending transversely of the upper support flange, and connecting means slideably connecting the subgirt to the upper support flange. A plurality of the support assemblies may be erected in end-to-end telescoping engagement to provide an intermediate row of the support assemblies to which the overlapped ends of adjacent courses of panel members are fixedly secured. The arrangement permits the overlapped ends and the subjacent subgirts to move as a unit relative to the stand-off supports under various thermal conditions, without elongating the fastener holes, without rupturing the lap seal, and without introducing regions incapable of supporting foot traffic and other live loads.

The present invention also provides improvements in a roof structure having spaced-apart generally parallel purlins. Thermal insulation overlies the purlins. An array of rows and columns of panel support assemblies are provided including a first row extending along a first purlin, a second row extending along a second purlin which is spaced from the first purlin, and plural intermediate rows, one extending along each of the remaining purlins. Plural side overlapped panel members are provided, extending between the aforesaid first and second rows. The panel members have a panel width substantially equal to a selected modular width. In accordance with the improvement of this invention, the panel support assemblies of each of the rows comprises plural end-to-end connected subgirts, each having a stand-off support connecting the subgirt to the subjacent purlin. Each of the panel support assemblies of the first row includes connecting means slideably connecting the subgirt to the associated stand-off support whereby the subgirts are capable of undergoing movement transversely of the associated purlin and parallel to the plane of the roof structure during thermal movement of the panel members connected thereto. The subgirts of the remaining support assemblies are fixed relative to the associated stand-off supports. First fastening means is provided fixedly securing the panel members to the support assemblies of the second row. Second fastening means is provided fixedly securing the panel members to the support assemblies of the first row. Concealed fastening means is provided mounted on the support assemblies of each of the remaining rows, slideably connecting the panel members to the subjacent support assemblies. The overall arrangement is such that while the panel members are fixedly secured to the support assemblies of the second row, the panel members are free to undergo thermal expansion and contraction.

DESCRIPTION OF THE PREFERRED EMBODIMENT (S)

Figure 1:
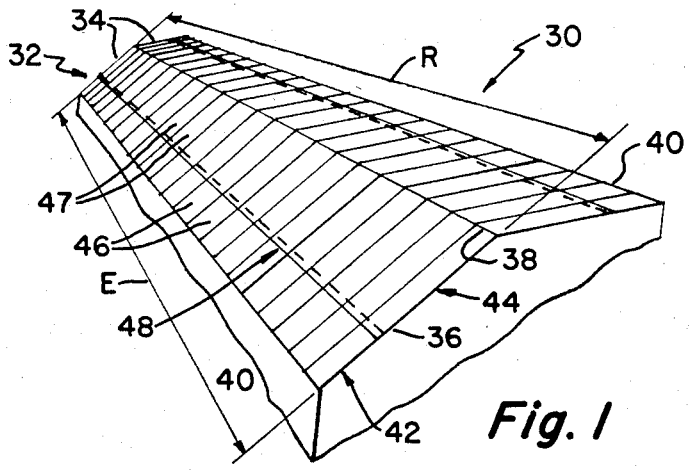
FIG. 1 is a fragmentary perspective view of a double pitched roof structure.

FIG. 1 illustrates a building 30 having a roof structure 32 constructed in accordance with this invention. The roof structure 32 may comprise a double-pitched roof including sloped portions, each having opposite ends 34, 36 and opposite sides 38, 40. The opposite sides 38, 40 correspond to the ridge and the eave of the roof. Each of the sloped portions includes first and second courses 42, 44 of panel members 46, 47. The panel members 47 of the second course 44 overlap the panel members 46 of the first course 42 to form a lap joint 48.

Before installation begins, the roof framing is checked for squareness, overall dimensions and eveness of plane. Differences between the "as built" dimensions and the "as engineered" dimensions can, as will become apparent later in the specification, be compensated for by adjusting the module of the panel support assemblies which, in turn, will adjust the coverage of the panels 46, 47.

A few examples will illustrate the capability in the present system to accommodate differences between the "as built" dimensions and the "as engineered" dimensions. Let us assume that in the building 30, the engineered dimension of the ridge length R and of the eave length E is 102 feet (31.09 M) and that thirty four of the panel members 46, 47 are required for each course, each having a nominal coverage width of 36" (91.44 cm).

Example I: Field measurements determine that the ridge and eave lengths R, E equal 101'-8" (30.99 M). Thus, the panel members 46, 47 must be shrunk 4" (10.16 cm). By adjusting the module of the panel support assemblies, thirty two runs of the panel members 46, 47 may be erected at a modular width of 35-$\frac{7}{8}$" (91.12 cm) and two runs of the panel members 46, 47 may be erected at a modular width of 36" (91.44 cm).

Example II: Field measurements indicate that the ridge and eave lengths R and E equal 102'-3" (31.17 M). Thus, the panel members 46, 47 must be stretched 3" (7.62 cm). By adjusting the module of the panel support assemblies, twenty four runs of the panel members 46, 47 may be erected at a modular width of 36-$\frac{1}{8}$" (91.76 cm) and ten runs of the panel members 46, 47 may be erected at a modular width of 36".

Example III: Field measurements indicate that the ridge length R is 102'-4" (31.19 M) and that the eave length E is 101'-8" (30.99 M). During erection, the upper ends of the panel members 47 must be stretched 4" (10.16 cm) at the ridge, while the lower ends of the panel members 46 must be shrunk 4" (10.16 cm) at the eave. By adjusting the module of the support assemblies, thirty two runs of the panel members 46, 47 may be installed having a modular width at the ridge of 36-$\frac{1}{8}$" (91.76 cm) and a modular width at the eave of 35-$\frac{7}{8}$" (86.1 cm). Two runs of the panel members 46, 47 may be erected at a modular width of 36" (91.44 cm).

The sequence of erecting the present roof structure will be illustrated with reference to FIGS. 2 through 7.

Figure 2:
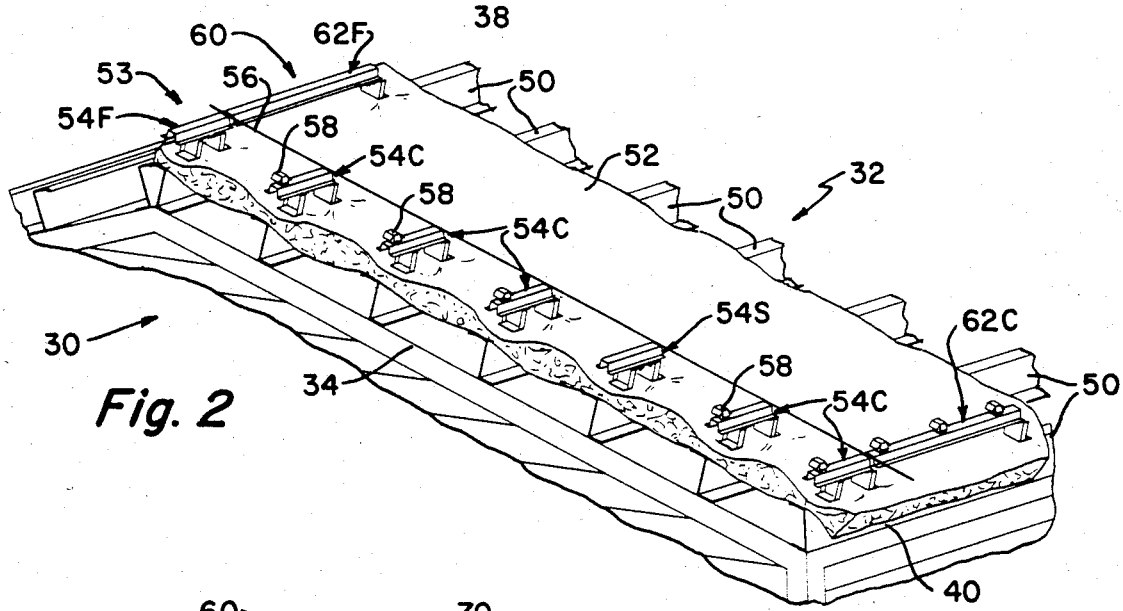
FIGS. 2, 4, 5 and 6 are fragmentary isometric views illustrating the sequence of erecting the present roof structure.

Referring to FIG. 2, the steel framing of the building 30 includes spaced purlins 50 extending between the opposite ends 34 (36) parallel with the opposite sides 38, 40. Thermal insulation 52 is laid across the purlins 50 from the ridge 38 to the eave 40, and properly tensioned by means not illustrated. The present system incorporates three distinct types of panel support assembly, that is a fixing support assembly designated by the suffix F, to which panel member ends are fixedly secured; a clipping support assembly designated by the suffix C, to which panel members are slideably connected by fixed and movable clip means; and a sliding support assembly designated by the suffix S, to which overlapped panel member ends are fixedly secured and which allow thermal movement of the lap joint.

A column 53 of starter support assemblies 54 is provided, including one fixing assembly 54F, one sliding assembly 54S, and plural clipping assemblies 54C. Each starter assembly 54 having a length, for example, of 6" (54.24 cm), is carefully installed adjacent to the roof end 34 at the prescribed location and in alignment with all other starter assemblies. To assure alignment, the fixing assembly 54F is secured to the purlin 50 at the ridge 38 and one of the clipping assemblies 54C is secured to the purlin 50 at the eave 40. The remaining starter assemblies 54 may be aligned using, for example, a string 56 extending between the corresponding ends of the fixed and clipping assemblies 54F, 54C. Exact positioning of the starter assemblies 54 relative to the end 34 of the roof structure 32 is essential since these assemblies position the remaining support assemblies of each row. It will be noted that each of the clipping support assemblies 54C is provided with one fixed clip means 58 of the type which will hereinafter be described.

Figure 3:
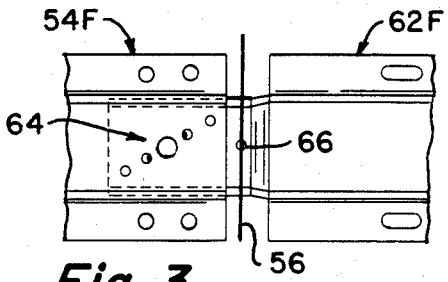
FIG. 3 is a fragmentary plan view of telescopingly engaged subgirts of this invention.

A second column 60 of panel support assemblies 62 is installed next. Initially fixed and clipping support assemblies 62F, 62C are telescopingly engaged with the fixed and clipping starter assemblies 54F, 54C. FIG. 3 illustrates the telescoping connection between the adjacent support assemblies 54F, 62F. Moduling means 64 is provided for setting the required modular width during installation of each of the support assemblies. As will hereinafter be described, the moduling means 64 provides a module adjustment, for example, of $\pm\frac{1}{8}$" (3.175 mm) in 1/16" (1.588 mm) increments. Each of the support assemblies presents a reference point, such as a registration aperture 66 in the exposed portion of the support assembly for use in conjunction with the string 56 to align the support assemblies.

Reverting to FIG. 2, the fixed and clipping support assembly 62F, 62C are locked into the 36" module position; and are temporarily clamped or permanently secured to the subjacent purlins 50. The string 56 is stretched between the registration aperture 66 (FIG. 3) of the previously installed fixed and clipping support assembly 62F, 62C.

Figure 4:
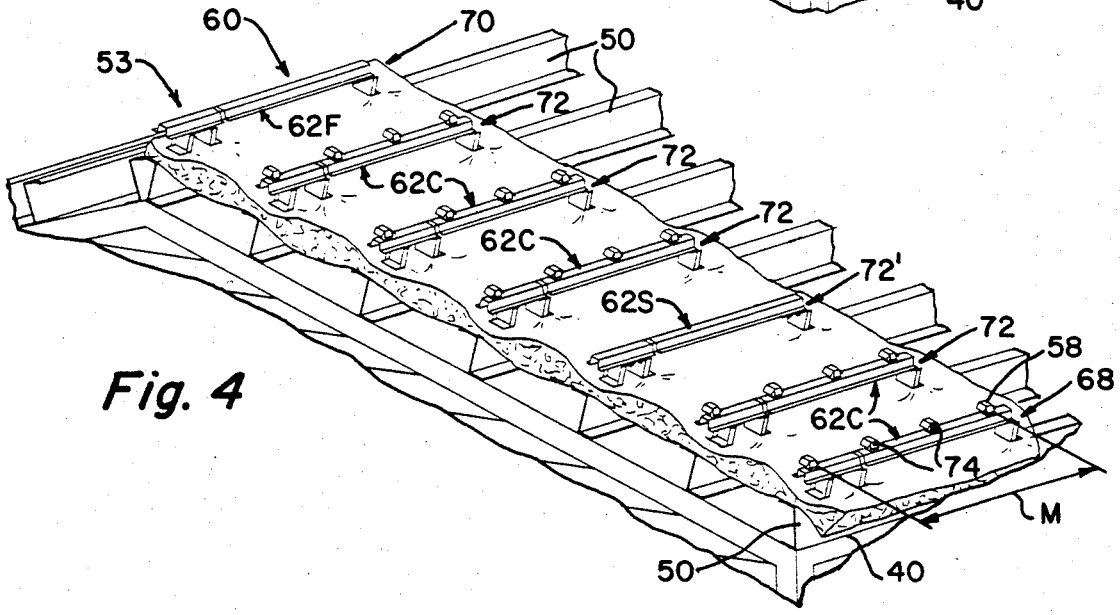

Thereafter, as shown in FIG. 4, all of the intermediate support assemblies including the single sliding support assembly 62S and the plural clipping support assembly 62C can be quickly inserted into their respective starter assemblies 4S, 54C and aligned and locked into the "best fit" position utilizing the string 56 and the registration apertures 66. Any slight errors in alignment of the starter assemblies 54 can be corrected using moduling means 64, as will be described. The intermediate support assemblies 62S, 62C are either temporarily clamped or permanently secured to the subjacent purlins 50.

As can be seen in FIG. 4, the arrangement provides a first end row 68 of clipping assemblies extending along the purlin 50 at the roof side or eave 40; a second end row of fixing assemblies extending along the purlin 50 at the opposite roof side or ridge 38; and a plurality of intermediate rows including intermediate rows 72 consisting of plural clipping assemblies aligned along the subjacent purlins, and a selected intermediate row 72' consisting of sliding assemblies extending along and secured to the subjacent purlin. The overall arrangement provides an array of rows 68, 70, 72 and 72', and columns 53, 60 . . . n of panel support assemblies 54, 62 . . . m. It will be noted that each of the clipping assemblies 62C present a single fixed clipped means 58 and plural movable clip means 74 which are uniformly spaced along the support assembly. Through the use of the moduling means 64 (FIG. 3) the support assemblies of each row are locked into the predetermined position such that the distance between the fixed clip means 58 of adjacent support assemblies is set at a modular spacing M. The required modular spacing M is predetermined by field measurement of the steel framing as explained in Examples I through III.

Figure 5:
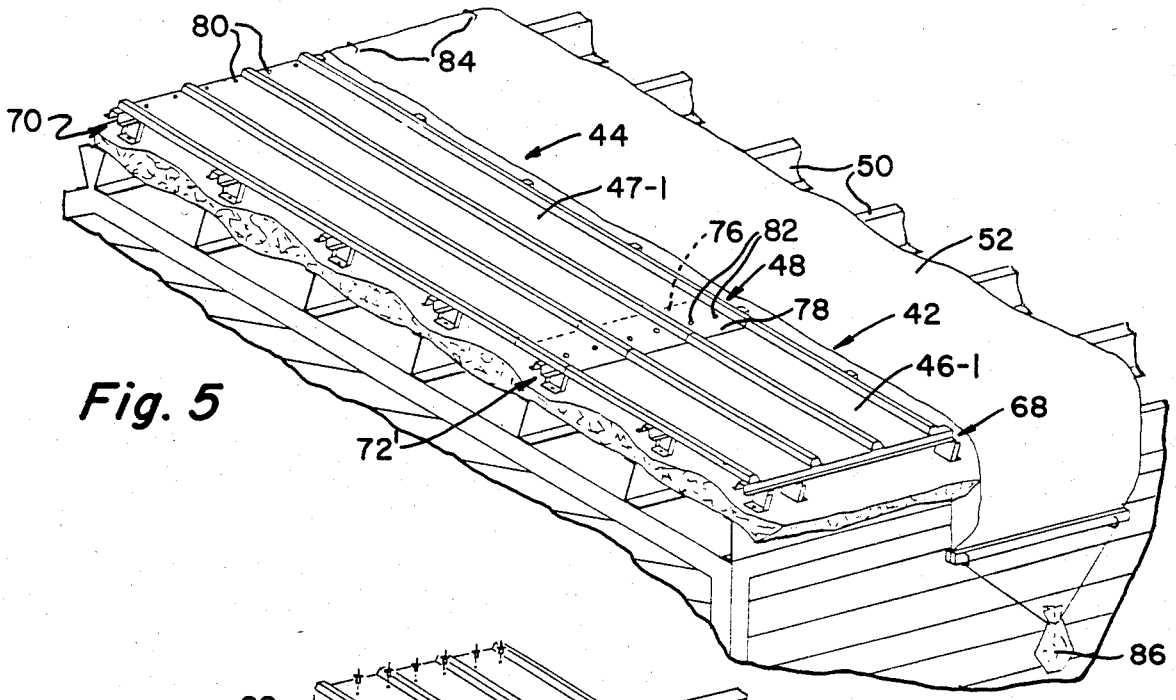
Figure 6:
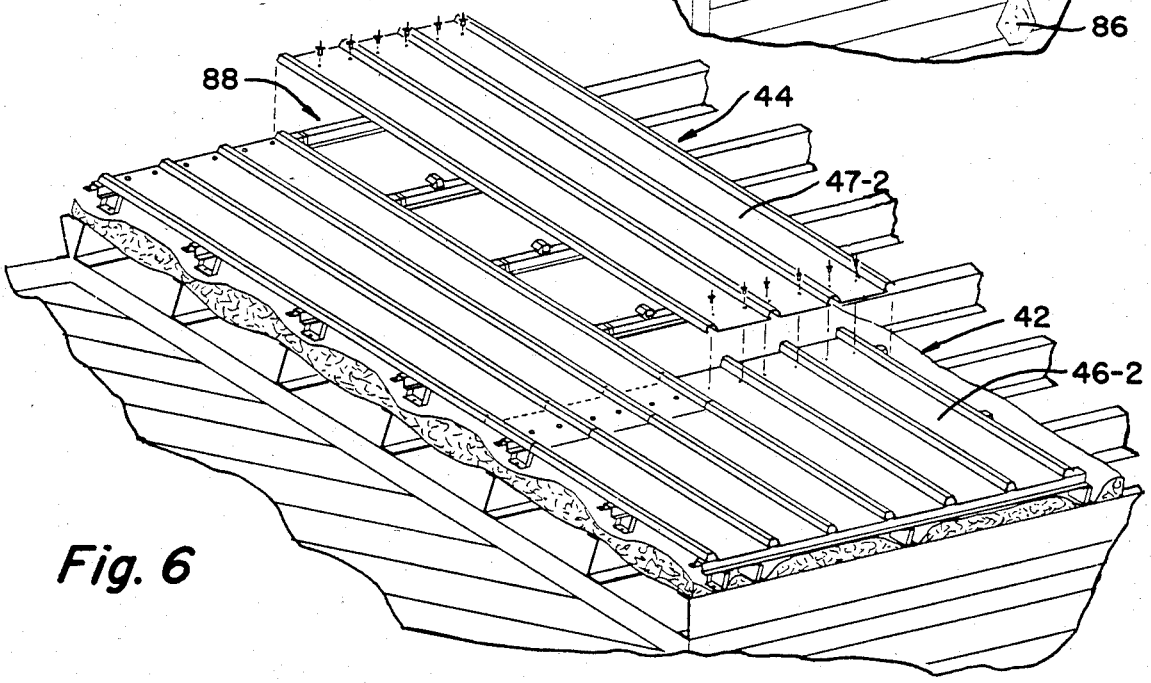

Referring to FIG. 5, a first panel member 46-1 of the first course 42 is carefully positioned over the subjacent clip means and snapped thereover with firm hand or foot pressure applied at each clip means location. The first panel member 46-1 extends from the first end row 68 to and beyond the selected intermediate row 72'. A first panel member 47-1 of the second course 44 is positioned over the subjacent clip means and is snapped over the clip means with firm hand or foot pressure applied at each clip means location. The first panel member 47-1 extends from the second end row 70 to and beyond the selected intermediate row 72' of support assemblies. The first panel members 46-1, 47-1 present underlapping and overlapping ends 76, 78, respectively, which form the lap joint 48. While not specifically illustrated, beads of a suitable sealant material are applied to the underlapping end 76. When the first panel member 47-1 is installed the overlapping end 78 thereof engages the sealant beads and forms a rather tight seal.

Figure 7:
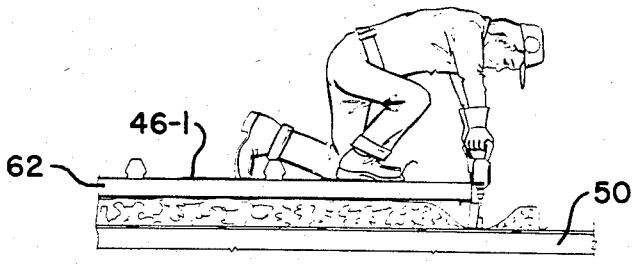
FIG. 7 is a fragmentary elevation view illustrating the use of a previously erected panel member as a working surface.

First fastening means, such as positive fasteners 80 fixedly secure the end of the first panel 47-1 to the subjacent support assemblies of the second end row 70. Second fastening means, such as positive fasteners 82 fixedly secure the overlapped ends 76, 78 to the subjacent support assemblies of the selected intermediate rows 72'. Concealed fastening means comprising the fixed and movable clip means 58, 74 (FIG. 4) slideably connect the panel members 46-1 and 47-1 to the subjacent support assemblies. Once the panel members 46-1 and 47-1 are snapped into position, they may be used as a platform, as illustrated in FIG. 7, to secure each support assembly 62 to the purlins 50.

The erection sequence described in connection with FIGS. 2 through 5, is repeated. That is, as illustrated in FIG. 5, thermal insulation 52 is applied across the purlins 50 and retained in place by suitable clamping means 84 and tensioning means 86. A third row 88 (FIG. 6) of support assemblies 62 identical to the second row 60 (FIG. 4) is installed as described above. Second panel members 46-2 and 47-2 of the first and second rows 42, 44 are sequentially installed as described above. The process is repeated until all of the support assemblies 62 and the panel members 46, 47 have been installed to complete the roof structure 32.

While the moduling means 64 (FIG. 3) provides a means for locking each of the support assemblies in the required modular spacing M (FIG. 4) every second or third row of support assemblies and panels should be checked for alignment and coverage to insure that the desired modular spacing M is being maintained.

It is to be understood that FIGS. 1 to 6 illustrate but one of a variety of roof structures. Thus in each type of roof structure according to this invention, the rows 70, 72' of fixing and sliding assemblies will be located according to the requirements of the roof configuration, so as to accommodate properly thermal movement of the panel members. In some structures more than one row 70 and/or row 72' may be needed. The row 72' of sliding assemblies may, in some structures, be used at the ends of the panel members at locations, such as the eave or ridge where exposed fasteners secure extrinsic structures, such as gutters and ridge caps, for example. Where side-by-side runs of end-overlapped panel members are erected, the row 70 of fixing assemblies preferably is positioned near the center of the runs so that each half of the runs accommodates substantially one-half of the thermal movement.

Figure 27:
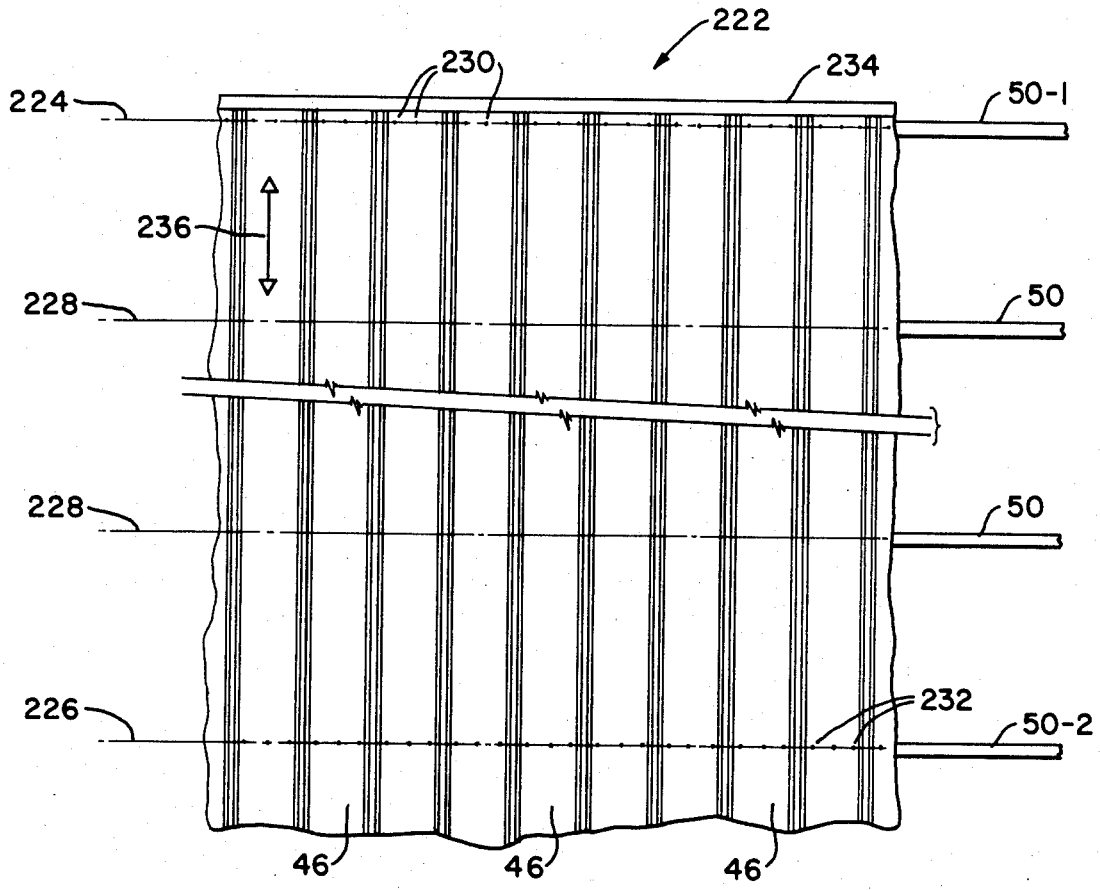
FIG. 27 is a broken, fragmentary plan view of a roof structure according to this invention.

In general, the present invention provides a novel arrangement for accommodating thermal movement of the panel members. For example, FIG. 27 illustrates a fragment of a roof structure 222 wherein the rows of support assemblies are represented schematically by dash-dot lines. The roof structure 222 includes a first row 224 of the sliding assemblies mounted along a first purlin 50-1; a second row 226 of the fixing assemblies mounted along a second purlin 50-2 which is spaced-apart from the first purlin 50-1; and intermediate rows 228 of the clipping assemblies mounted along the intermediate purlins 50. A structure 234, such as a gutter or ridge cap, is connected to the sliding assemblies of the first row 224. Plural, edge overlapped panel members 46 extend across the rows 224, 226 and 228. First and second fastening means, such as exposed fasteners 230, 232, fixedly secure the panel members 46 to the sliding and fixing assemblies of the first and second rows 224, 226. Concealed fastening means (not visible), such as the fixed and movable clip means 58, 74 (FIG. 4) slideably connect the panel members 46 to the adjacent support assemblies. The arrangement is such that while the panel members 46 are fixedly secured to the fixing assemblies of the second row 226, the panel members 46 are free to undergo thermal movement—as represented by the double arrow 236—relative to the second row 226.

It will be observed in FIG. 27 that the panel members 46 are shown extending from the first row 224 to and beyond the second row 226. This showing is intended to indicate that the panel members 46 may extend across another set of the intermediate rows to a second row of the sliding subgirts.

Figure 8:
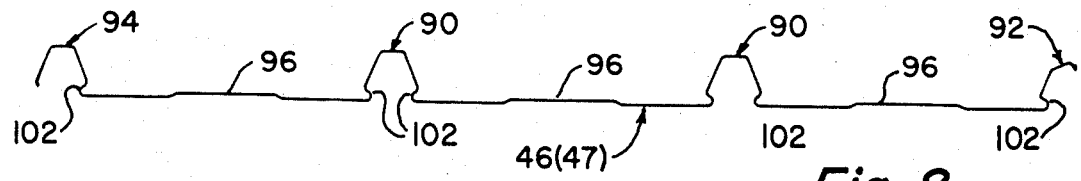
FIG. 8 is an end view illustrating the profile of a panel member.

FIG. 8 illustrates, in end elevation, the panel member 46(47) which presents upstanding intermediate ribs 90, male and female partial ribs 92, 94 along opposite longitudinal edges of the panel 46(47), and panel webs 96 connecting adjacent ones of the ribs 90, 92, 94. Each of the partial ribs 92, 94 is overlappable and interfittable with a complementary partial rib 94, 92 of adjacent ones of the panel members 46(47) to provide a joint rib having a cross-sectional configuration duplicating that of the intermediate ribs 90. Each of the intermediate ribs 90 includes spaced-apart inturned base portions 102 connecting the rib 90 to adjacent ones of the panel webs 96. Each of the male and female partial ribs 92, 94 is connected to the adjacent panel web 96 by an inturned base portion 102. For a more detailed description of how the fixed and movable clip means 58, 74 interengage the ribs of the panel members 46(47), reference is made to the aforesaid copending application Ser. No. 376,169, now U.S. Pat. No. 4,486,998; and to copending application Ser. No. 249,062 filed Mar. 30, 1981 and now U.S. Pat. No. 4,400,922 which is assigned to the assignee of this invention.

Figure 9:
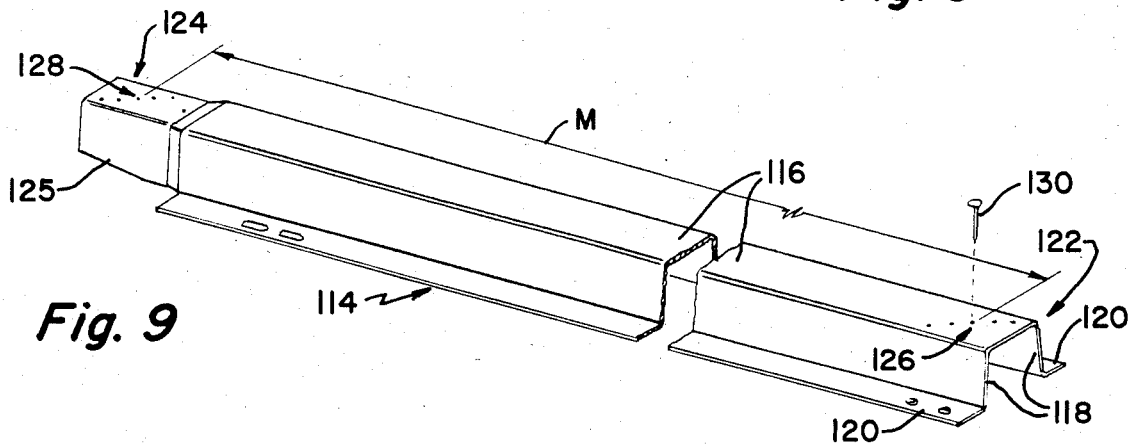
FIG. 9 is a broken isometric view of a subgirt incorporating aperture sets of this invention.

Each of the support assemblies includes, in part, a subgirt 114, such as illustrated in FIG. 9. The subgirt 114 includes an upper wall 116, depending sidewalls 118, and outwardly extending flanges 120. The subgirt 114 presents a first end 122 and opposite thereto a countersunk second end 124 adapted for telescoping engagement with the first end of an adjacent subgirt. The lower face of the second end 124 preferably is beveled as at 125. The presence of the bevel 125 allows the subgirt 114 to be elevated at its first end 122 and introduced into the first end of the adjacent subgirt without being dragged across the insulation.

The aforesaid moduling means 64 comprises cooperating aperture sets including a first set 126 of apertures in the upper wall 116 at the first end 122; and a second set 128 of apertures in the upper wall 116 at the countersunk second end 124. Locking means, such as a roofing nail 130 is provided for locking the first and second ends 122, 124 of adjacent subgirts in adjusted relationship.

Figure 10:
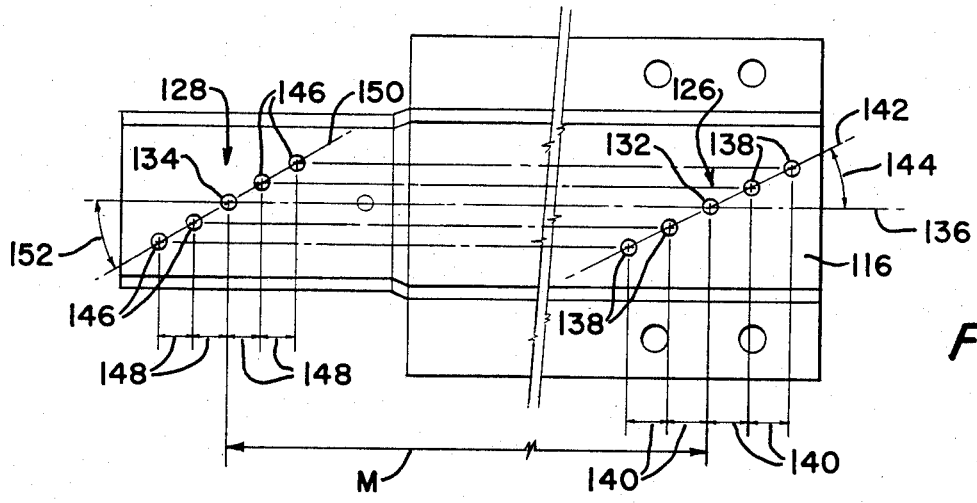
FIG. 10 is a broken plan view of the subgirt of FIG. 9, illustrating relationships between the aperture sets.

Referring to FIG. 10, the first and second aperture sets 126, 128 include reference apertures 132, 134, respectively, aligned along a longitudinal centerline 136 of the upper wall 116. The reference apertures 132, 134 are spaced apart at the selected modular width M. The first aperture set 126 includes additional apertures 138 which, together with the reference aperture 132, are uniformly spaced-apart at a first distance 140 measured in a direction parallel with the longitudinal centerline 136. The apertures 132, 138 are aligned along an axis 142 which intersects the centerline 136 at a first acute angle 144.

The second aperture set 128 includes additional apertures 146 which together with the reference aperture 134, are uniformly spaced-apart at a second distance 148 measured in a direction parallel with the longitudinal centerline 136 and which is different from the first distance 140. The apertures 134, 146 are aligned along an axis 150 which intersects the longitudinal centerline 136 at a second acute angle 152 which is different from the first acute angle 144.

Figure 11:
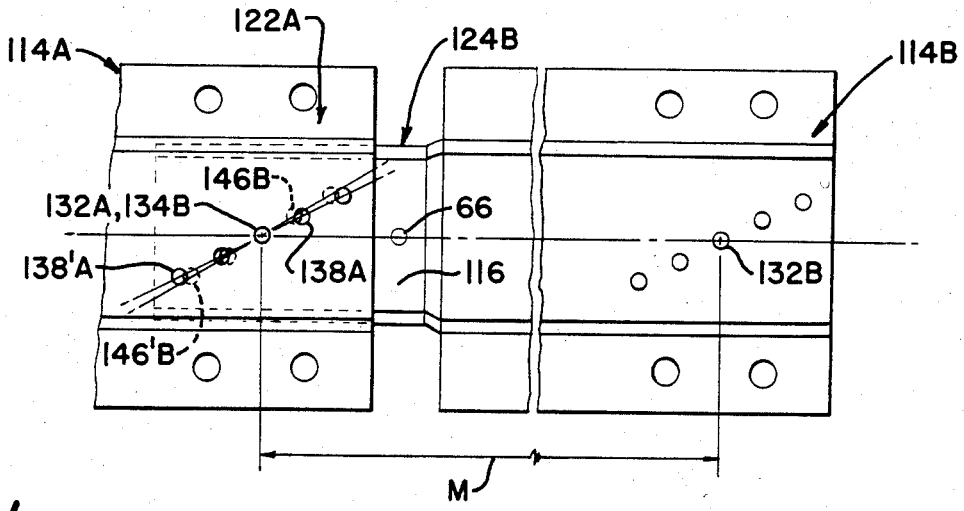
FIG. 11 is a broken, fragmentary plan view illustrating end-to-end connected subgirts of FIG. 10.

As illustrated in FIG. 11, when the second end 124B of an adjacent subgirt 114B is inserted into the first end 122A of the subgirt 114A, the reference apertures 132A, 134B are brought into coincidence. In this position the reference apertures 132A, 132B are spaced-apart at the selected modular width M. It will be appreciated that to increase the modular width M by an incremental distance, the second end 124B may be retracted from the first end 122A to bring the apertures 138A and 146B into coincidence. To decrease the modular width M, the second end 124B may be inserted further into the first end 122A to bring, for example, the apertures 138'A and 146'B into coincidence. The overall arrangement of the cooperating aperture sets is such that the apertures 132A, 138A of the first set at the first end 122A of the subgirt 114A cooperate with the apertures 134B, 146B of the second set at the second end 124B of the adjacent subgirt 114B during movement of the second end 124B relative to the first end 122A to bring successive pairs of corresponding apertures into coaxial alignment thereby to adjust the distance between the reference aperture 132B at the first end of the adjacent subgirt 114B and the reference aperture 132A at the first end 122A of the subgirt 114A.

It will be observed in FIG. 11 that the registration aperture 66 is provided in the upper wall 116 intermediate of the cooperating aperture sets. For example, the registration aperture 66 may be provided in the top wall 116 of the countersunk second end 124B at a location where it will be visible even when the first and second ends 122A, 124B are fully engaged.

Figure 12:
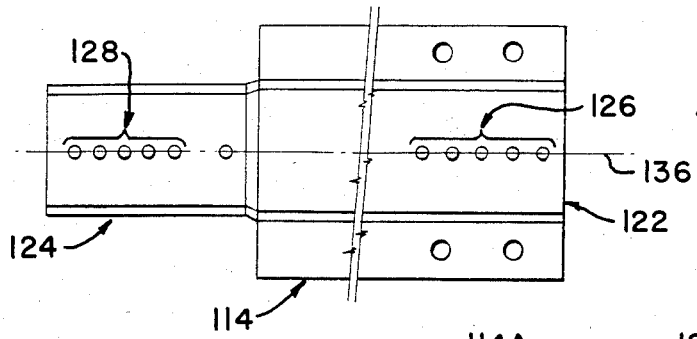
FIG. 12 is a broken plan view of a subgirt incorporating aperture sets of an alternative arrangement.
Figure 13:
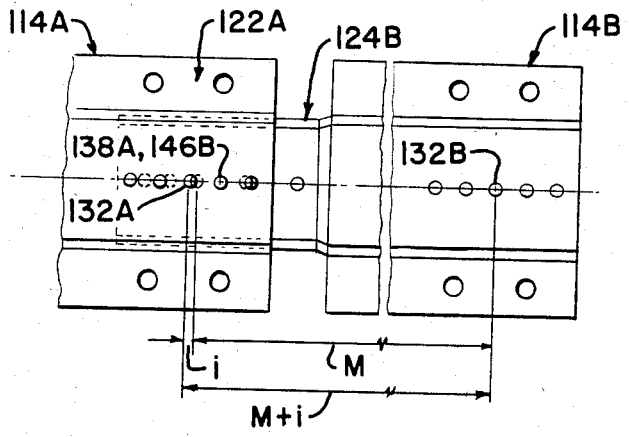
FIG. 13 is a broken, fragmentary plan view illustrating end-to-end connected subgirts of FIG. 12.

FIG. 12 illustrates an alternative arrangement of the cooperating aperture sets wherein the first and second aperture sets 126, 128 are aligned along a common axis which, as illustrated, comprises the longitudinal centerline 136. FIG. 13 illustrates the engaged first and second ends 122A, 124B of adjacent support assemblies 114A, 114B. For the purposes of illustration, the apertures 138A, 146B are presented in coaxial alignment. Thus the modular width M has been increased by the increment i, such that the distance between the reference apertures 132A, 132B has now been increased to M+i.

Figure 14:
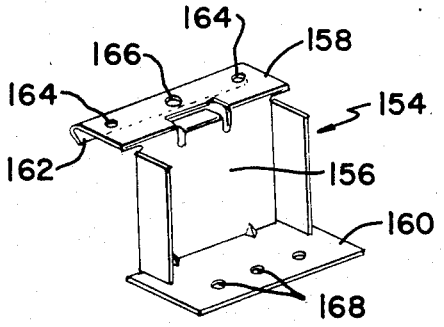
FIG. 14 is an isometric view illustrating a stand-off support.

The subgirt 114 of FIG. 9 may be provided with a standoff support 154 illustrated in FIG. 14. The standoff support 154 comprises a generally vertical web 156, an upper support flange at the upper end of the web 156, terminating in a terminal strip 162 which is bent downwardly out of the plane of the flange 158, and a base or lower support flange 160 at the lower end of the web 156. The upper flange 158 is provided with spaced-apart fastener receiving openings 164 and a centrally located centering aperture 166 the function of which will hereinafter be described. The lower support flange 160 likewise is provided with spaced fastener receiving openings 168 used in securing the stand-off support 154 to a purlin.

Figure 28:
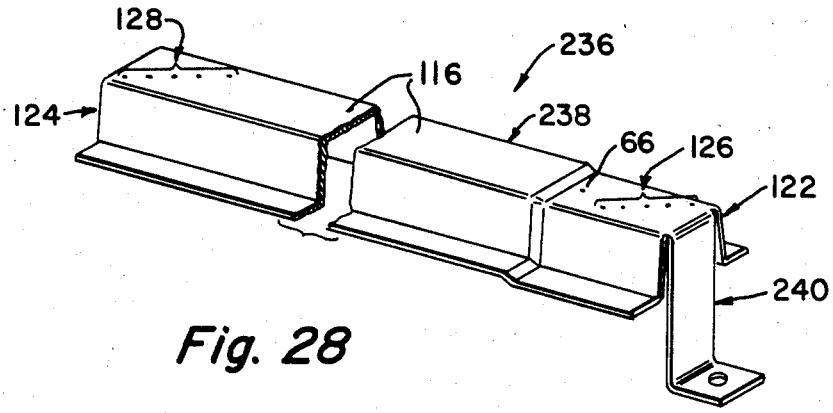
FIG. 28 is a broken, isometric view of an alternative support assembly.

FIG. 28 illustrates a unitary support assembly 236 comprising a subgirt 238 and an integrally formed stand-off support 240 consisting of a segment of the upper wall 116. The assembly 236 includes first and second ends 122, 124 adapted for telescoping engagement with the second and first ends of adjacent ones of the assembly 238. In this embodiment, the first end 122 is countersunk, the second end 124 of an adjacent assembly 238 being fitted over the countersunk first end 122. The subgirt 238 being provided with the above-described cooperating aperture sets 126, 128 and registration aperture 66, is erected in the same manner described above. The support assembly 236 may be used only as a fixing assembly or a clipping assembly.

Figure 15:
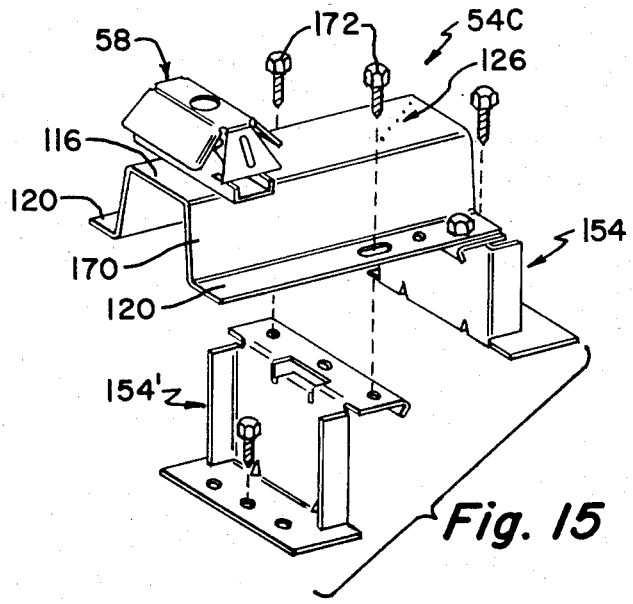
FIG. 15 is an exploded isometric view illustrating a clipping starter support assembly.

FIG. 15 illustrates one of the starter support assemblies 54, and in particular a clipping starter support assembly 54C. The assembly 54C comprises a relatively short subgirt 170 having a transverse profile identical to that of the first end 122 of the subgirt 114 (FIG. 9). The assembly 54C additionally includes a first stand-off support 154 secured to the extreme end of the subgirt 170, and a second stand-off support 154' which is spaced from and secured to the flanges 120 by fasteners 172. The second stand-off support 154' rigidifies the relatively short subgirt 170. A first aperture set 126 is provided in the upper wall 116 adjacent to the first standoff support 154. Fixed clip means 58 is secured to the upper wall 116 at the opposite end of the subgirt 170.

It is to be noted that the fixing and sliding support assemblies 54F, 54S (FIG. 2) differ from the clipping support assembly 54C in that the fixed clip means 58 is not provided. The sliding support assembly 54S (FIG. 2) also differs from the clipping support assembly 54C in that connecting means (to be described in connection with FIG. 20) is employed to slideably connect the subgirt 170 to the stand-off supports 154, 154'.

Figure 16:
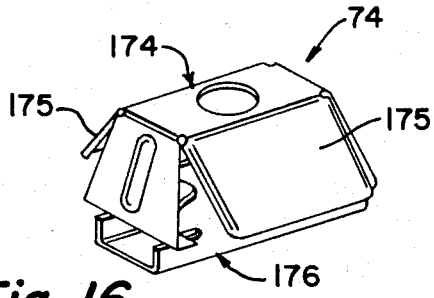
FIG. 16 is an isometric view of movable clip means.
Figure 17:
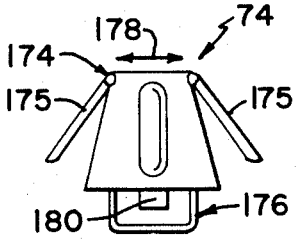
FIG. 17 is an end view of the movable clip means.

The movable clip means 74 (FIGS. 16, 17) comprises a top clip 174 which is slideably connected to a base clip 176 for limited movement transversely of the base clip 176 in the direction of the double headed arrow 178 in FIG. 17. As shown in FIG. 17, the top clip 174 presents relatively narrow tabs 180 (only one visible) which are engageable with the sidewalls of the base clip 176 to limit the transverse movement of the top clip 174. The top clip 174 presents divergent clamping wings 175 having lower edges adapted to engage interior surfaces of the inturned base portions 102 (FIG. 8) presented by each rib 90 and by the ribs formed by the partial ribs 92, 94 of adjacent panel members. For a more detailed description of the movable clip means 74, reference is directed, to the aforesaid copending U.S. patent application Ser. No. 249,062 now U.S. Pat. No. 4,400,922), that pending application being incorporated herein by reference.

Figure 18:
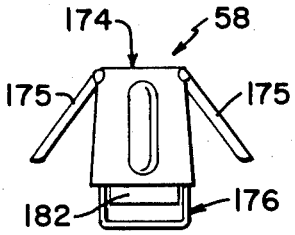
FIG. 18 is an end view of fixed clip means.

The fixed clip means 58 (FIG. 18) is similar to the movable clip means 74 in that it includes a top clip 174 and a base clip 176. The fixed clip means 58 differs from the movable clip means 74 in that relatively wide tabs 182 (only one visible) are provided to maintain the top clip 174 substantially fixed with respect to the base clip 176. The top clip 174 also presents the aforesaid divergent clamping wings 175. For a more detailed description of the fixed clip means 58 and the use thereof in combination with the movable clip means 74 to produce moduling of panel members, reference is made to the aforesaid U.S. patent application Ser. No. 376,169 (now U.S. Pat. No. 4,486,998), that applicatioh being incorporated herein by reference.

Figure 19:
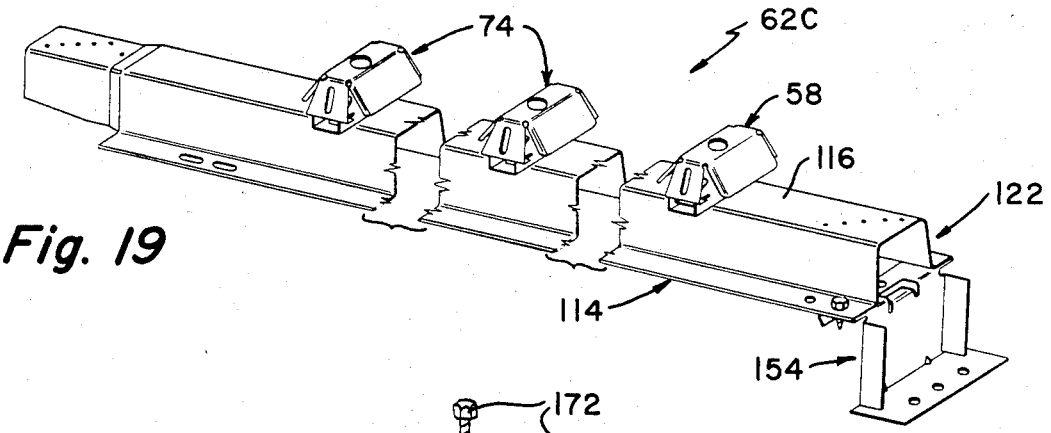
FIG. 19 is an isometric view illustrating a clipping panel support assembly.

FIG. 19 illustrates one of the support assemblies 62, and in particular the clipping support assembly 62C. The assembly 62C comprises the subgirt 114, the stand-off support 154 which is secured to the first end 122 of the subgirt 114, one fixed clip means 58 and plural, in this instance two movable clip means 74. The clipping support assembly 62C is factory assembled. Therefore, the fixed and movable clip means 58, 74 are precisely located on the upper wall 116 of the subgirt 114.

It should be noted that the fixing and sliding support assemblies 62F, 62S (FIGS. 2, 4) differ from the assembly 62C in that the fixed and movable clip means 58, 74 are not provided. It should also be noted that the sliding support assembly 62S (FIG. 4) also differs from the support assembly 62C in that connecting means (to be described in connection with FIG. 20) slideably connects the subgirt 114 to the stand-off support 154 to allow the panel members and the subgirt 114 to move as a unit during thermal expansion and contraction of the panel members.

Figure 20:
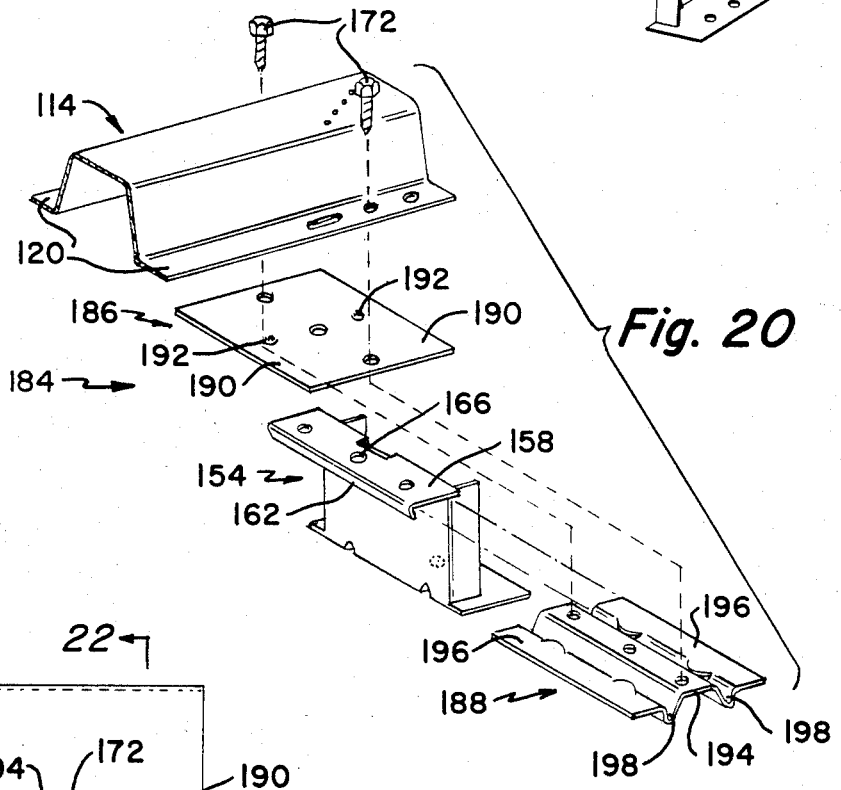
FIG. 20 is a fragmentary, exploded isometric view illustrating connecting means slideably connecting a subgirt to a stand-off support.

FIG. 20 illustrates the components of connecting means 184 for slideably connecting the subgirt 114 to the stand-off support 154. The connecting means 184 comprises a bearing plate 186 and a clamping plate 188. The bearing plate 186 includes lateral portions 190 each provided with a centrally located dimple 192. The clamping plate 188 comprises a central portion 194 and lateral portions 196 which are vertically offset from the central portion 194. Each of the lateral portions 196 is connected to the central portion 194 by a profiled portion providing a generally U-shaped groove 198.

Figure 21:
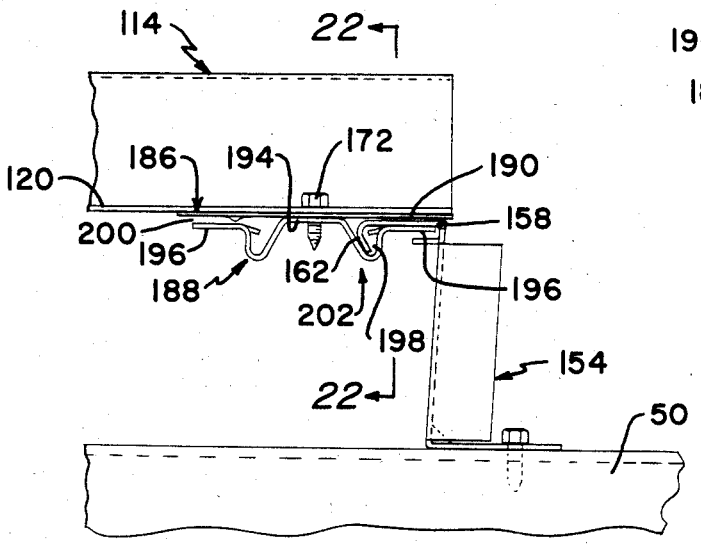
FIG. 21 is a fragmentary elevation view further illustrating the connecting means.

Referring to FIG. 21, it will be observed that the bearing plate 186 underlies the subgirt flanges 120 and has one of the lateral portions 190 overlying the upper support flange 158. The central portion 194 of the clamping plate 188 engages a lower surface of the bearing plate 186. One of the lateral portions 196 underlies the upper support flange 158. Fastening means, such as the fasteners 172 (only one visible) secure the subgirt flanges 120 to the clamping plate 188 with the bearing plate 186 clamped therebetween.

It will be observed in FIG. 21 that a space 200 is presented between each lateral portion 190 of the bearing plate 186 and the confronting lateral portion 196 of the clamping plate 188. The vertical dimension of the space 200 preferably is greater than the thickness of the upper support flange 158 of the stand-off support 154 to allow relatively free movement of the subgirt 114 relative to the stand-off support 154. For example, in one commercial embodiment, the vertical dimension of the space 200 is 0.094" (2.388 mm) whereas the thickness of the support flange 158 is 0.0635" (1.163 mm).

The connecting means 184 incorporates guide means 202 associated with the stand-off support 154 and one of the plates 188(186), for guiding movement of the subgirt 114 relative to the stand-off support 154, induced by thermal expansion and contraction of a panel member. The guide means 202 comprises the terminal strip 162 presented by the upper support flange 158, and the generally U-shaped groove 198 which receives and is guided by the terminal strip 162.

Figure 22:
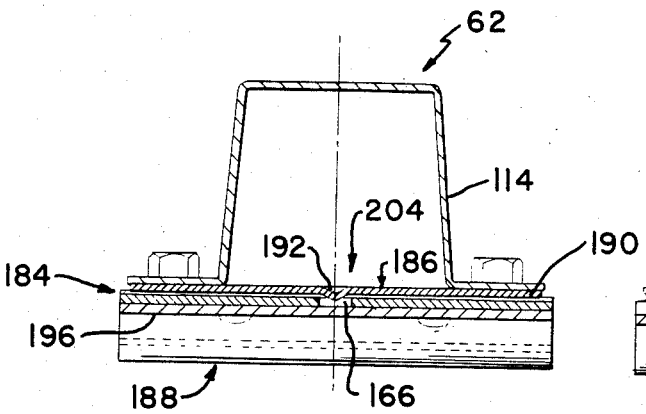
FIG. 22 is a cross-sectional view, taken along the line 22—22 of FIG. 21, illustrating centering means.

The connecting means 184 also incorporates centering means 204 (FIGS. 22, 23) for initially centering the connecting means 184 on the upper support flange 158 during assembly. The centering means 204 includes the centering aperture 166 and the dimple 192. FIG. 22 illustrates the factory assembled support assembly 62 wherein the dimple 192 extends into the centering aperture 166 and retains the connecting means 184 centered with respect to the upper support flange 158.

Figure 23:
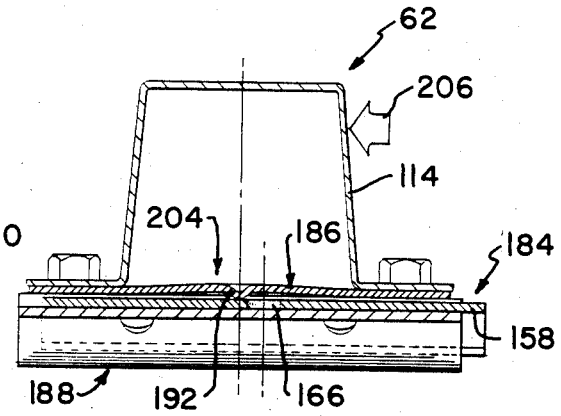
FIG. 23 is a view similar to FIG. 22, illustrating thermal movement of the subgirt relative to the fixed stand-off subgirt.

The bearing plate 186 is manufactured from relatively thin gauge sheet metal. In a commercial embodiment, the bearing plate 186 is formed from sheet metal having a thickness of 0.056" (1.311 mm). The bearing plate 186 is therefore relatively flexible. The arrangement is such that when, as shown in FIG. 23, a panel member (not illustrated) secured to the subgirt 114 undergoes thermal expansion, a force represented by the arrow 206 causes the subgirt 114 and the bearing and clamping plates 186, 188 to move relative to the fixed upper support flange 158. During this movement, the dimple 192 rides over an edge of the centering aperture 166 causing the bearing plate 186 to be deflected as illustrated in FIG. 23. As the panel undergoes thermal contraction, the subgirt 114 and the connecting means 184 move relative to the upper support flange 158 back to or beyond the centered position illustrated in FIG. 22 depending on the temperature differentials.

Figure 25:
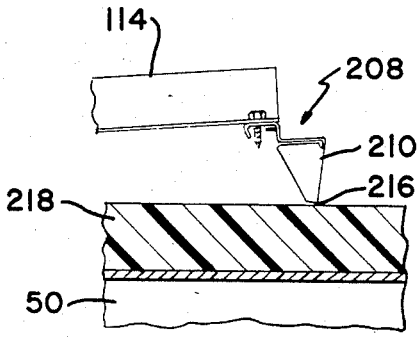
FIGS. 25 and 26 are fragmentary cross-sectional views illustrating the installation of a subgirt using the stand-off support of FIG. 24.
Figure 26:
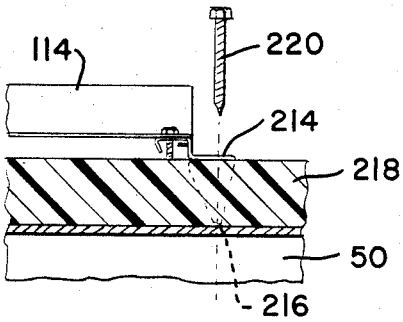
Figure 24:
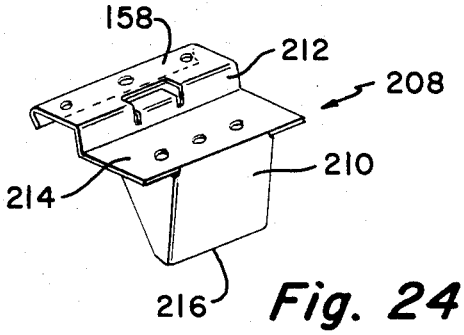
FIG. 24 is an isometric view of a stand-off support used with rigid insulation.

FIG. 24 illustrates an alternative stand-off support 208 adapted for use with rigid insulation. The stand-off support 208 includes lower and upper generally vertical web segments 210, 212 which are laterally offset and connected by a horizontal web segment 214. The hereinbefore described upper support flange 158 adjoins an upper end of the upper web segment 212. The lower web segment 210 presents a lower edge 216 adapted to penetrate the rigid insulation. As illustrated in FIG. 25, rigid insulation 218, such as a board of rigid foamed plastics, overlies the purlin 50. The stand-off support 208 is secured to the subgirt 114 in the manner described above. During installation, the lower edge 216 is pressed through the rigid insulation 218 until it comes to rest on the purlin 50. Thereafter, a fastener 220 is inserted through the horizontal web segment 214 through the rigid insulation 118 and is threadedly engaged in the purlin 50.

I claim:

1. A subgrit for supporting panel members, including an upper wall having a longitudinal centerline;

first and second ends adapted for telescoping engagement with the second and first ends of adjacent subgirts;

a first set of apertures in the upper wall at the first end, apertures of said first set being uniformly spaced-apart at a first distance;

a second set of apertures in the upper wall at the second end, the apertures of said second set being uniformly spaced-apart at a second distance different from said first distance;

said first set and said second set including reference apertures which are spaced-apart at a distance substantially equal to a selected modular width; and locking means for locking the first and second ends of adjacent subgirts in an adjusted relationship;

whereby during movement of the second end of said adjacent subgirt relative to the first end, successive pairs of corresponding apertures are presented in coaxial alignment, each of said successive pairs comprising an aperture from said first set and an aperture from said second set, one of said pairs being selected to set the distance between the reference aperture at the first end of said adjacent subgirt and the reference aperture of the first end of said subgirt.

2. The subgirt as defined in claim 1 wherein the apertures of said first set and the apertures of said second set extend in a direction parallel with said longitudinal centerline.

3. The subgirt as defined in claim 2 wherein the apertures of said first set and of second set are aligned along a common axis.

4. The subgirt as defined in claim 3 wherein said common axis comprises said centerline.

5. The subgirt as defined in claim 1 wherein the apertures of said first set are disposed along a first axis which intersects said centerline at a first acute angle; and the apertures of first said second set are disposed along a second axis which intersects said centerline at a second acute angle which is different from said first acute angle.

6. The subgirt as defined in claim 1 wherein said locking means comprises a pin insertable into coaxially aligned apertures of said first set and of said second set.

7. The subgirt as defined in claim 1 including a stand-off subgirt depending from the first end.

8. The subgirt as defined in claim 1 wherein each of said reference apertures comprises a central aperture of one said set.

9. The subgirt as defined in claim 1 wherein the apertures of said first set correspond in number to that of said second set.

10. The subgirt as defined in claim 5 wherein the apertures of said first set correspond in number to that of said second set.

11. A support assembly for panel members, comprising:

a stand-off support having a web, an upper support flange extending laterally of an upper web end, and a base at a lower web end;

an elongated subgirt having spaced-apart outwardly directed subgirt flanges extending transversely of said upper support flange; and connecting means slideably connecting said subgirt to said upper support flange, comprising:

a bearing plate underlying said subgirt flanges and having a lateral bearing portion overlying said upper support flange;

a clamping plate having a central portion engaged with a lower surface of said bearing plate and a lateral clamping portion vertically offset from the plane of said central portion and underlying said upper support flange;

fastening means securing said subgirt flanges to said clamping plate with said bearing plate clamped therebetween; and guide means associated with said stand-off support and one said plate, for guiding movement of said subgirt relative to said stand-off support, induced by thermal expansion and contraction of a panel member secured to said subgirt.

12. The support assembly as defined in claim 11 wherein said guide means comprises:

a terminal strip on said upper support flange bent out of the plane of said upper support flange; and a generally U-shaped groove in said one said plate receiving said terminal strip.

13. The support assembly as defined in claim 12 wherein said U-shaped groove is provided in said clamping plate.

14. The support assembly as defined in claim 11 including centering means for centering said connecting means on said upper support flange, comprising:

an aperture in said upper support flange; and a dimple formed in one said portion and engaged in said aperture.

15. In a roof structure having spaced-apart generally parallel purlins; thermal insulation overlying said purlins; an array of rows and columns of panel support assemblies including a first row extending along a first purlin, a second row extending along a second purlin spaced from said first purlin, and plural intermediate rows, one extending along each of the remaining purlins; plural side overlapped panel members extending across the first, intermediate, and second rows, said panel members having a panel width substantially equal to a selected modular width; the improvement comprising:

the panel support assemblies of each of said rows comprising plural end-to-end connected subgirts each having a stand-off support connecting the subgirt to the subjacent purlin;

each of the panel support assemblies of said second row including connecting means slideably connecting the subgirt to the associated stand-off support for movement transversely of the associated purlin and parallel to the plane of said roof structure;

the subgirts of the remaining support assemblies being fixed relatives to the associated stand-off supports;

first fastening means fixedly securing the panels to the support assemblies of the first row;

second fastening means fixedly securing said panels to the support assemblies of said second row; and concealed fastening means mounted on the support assemblies of each of the remaining rows, slideably connecting the panel members to the subjacent support assemblies;

whereby while the panel members are fixedly secured to the support assemblies of said second row, the panel members are free to undergo longitudinal thermal expansion and contraction relative to said second row.

16. The roof structure as defined in claim 15 wherein each subgirt comprises first and second ends adapted for telescoping engagement with the second and first ends of adjacent subgirts, and cooperating aperture sets, one at said first end and one at said second end, for setting the depth of engagement of said countersunk second end with the first end of said adjacent subgirt, said aperture sets including reference apertures which are spaced-apart at said selected modular width; and including locking means, locking the first and second ends of adjacent subgirts in an adjusted relationship;

whereby the second ends of the subgirts of each of said columns are substantially aligned along an imaginary line extending transversely of said rows.

17. The roof structure as defined in claim 16 including a reference point on an exposed portion of each subgirt to assist in aligning the second ends.

18. The roof structure as defined in claim 15 wherein each of said stand-off supports of said first row includes an upper support flange adjacent to said subgirt; and said connecting means comprises a bearing plate underlying said subgirt and having a lateral bearing portion overlying said upper support flange, a clamping plate having a central portion engaged with a lower surface of said bearing plate and a lateral clamping portion vertically offset from the plane of said central portion and underlying said upper support flange, fastening means securing said subgirt to said clamping plate with the bearing plate sandwiched therebetween, and guide means associated with said stand-off support and one said plate, for guiding movement of said subgirt relative to said stand-off support induced by thermal expansion and contraction of the panel member secured to the subgirt.

19. The support assembly as defined in claim 18 wherein said guide means comprises a terminal strip on said upper support flange bent out of the plane of said upper support flange, and a generally U-shaped groove in said one said plate receiving said terminal strip.

20. The support assembly as defined in claim 18 including centering means for centering said connecting means on said upper support flange, comprising an aperture in said upper support flange at an intermediate location thereon, and a dimple formed in one said portion and engaged in said aperture.

21. In a roof structure having spaced-apart generally parallel purlins; thermal insulation overlying said purlins; an array of rows and columns of panel support assemblies including a first row extending along a first purlin, a second row extending along a second purlin spaced from said first purlin, and plural intermediate rows, one extending along each of the remaining purlins; a first course of panel members extending from said first row to a selected intermediate row; a second course of panel members extending from said selected intermediate row to said second row; the panel members of said first course and of said second course presenting overlapping ends at the support assemblies of said selected intermediate row; said panel members having a panel width substantially equal to a selected modular width; the improvement comprising:

the panel support assemblies of each of said rows comprising plural end-to-end connected subgirts each having a stand-off support connecting the subgirt to the subjacent purlin;

each of the panel support assemblies of said selected intermediate row including connecting means slideably connecting the subgirt to the associated stand-off support for movement transversely of the associated purlin and parallel to the plane of said roof structure;

the subgirts of the remaining support assemblies being fixed relative to the associated stand-off supports;

first fastening means fixedly securing the panels of said second course to the support assemblies of said second row;

second fastening means fixedly securing said overlapped ends to the support assemblies of said selected intermediate row; and concealed fastening means mounted on the support assemblies of each of the remaining rows, slideably connecting the panel members of said first course and of said second course to the subjacent support assemblies;

whereby while the panel members of said second course are fixedly secured to the support assemblies of said selected intermediate row, the panel members of said first course and of said second course are free to undergo longitudinal thermal expansion and contraction relative to said first row and to said selected intermediate row.

* * * * *

UNITED STATES PATENT AND TRADEMARK OFFICE

CERTIFICATE OF CORRECTION

PATENT NO. : 4,594,823

DATED : June 17, 1986

INVENTOR(S) : James G. Hague

It is certified that error appears in the above-identified patent and that said Letters Patent are hereby corrected as shown below:

Cover page, After item [76], Add

- - [73] Assignee: H. H. Robertson Company
Pittsburgh, Pa. - - -.

Cover page, After "Assistant Examiner - Andrew Joseph Rudy",

Add as a new line, - - - Attorney, Agent, or
Firm - George E. Manias - - -.

Signed and Sealed this

Seventh Day of October, 1986

[SEAL]

*Attest:*

DONALD J. QUIGG

*Attesting Officer*

*Commissioner of Patents and Trademarks*